US006280349B1

(12) United States Patent
Cook

(10) Patent No.: US 6,280,349 B1
(45) Date of Patent: Aug. 28, 2001

(54) JOINT CONSTRUCTION METHOD AND ARTICLE CONSTRUCTED BY SAID METHOD

(76) Inventor: Donald R. Cook, 6750 Scio Church, Ann Arbor, MI (US) 48103

( * ) Notice: Subject to any disclaimer, the term of this patent is extended or adjusted under 35 U.S.C. 154(b) by 0 days.

(21) Appl. No.: 09/316,376

(22) Filed: May 21, 1999

(51) Int. Cl.[7] ..... A63B 53/04
(52) U.S. Cl. ..... 473/345; 473/349
(58) Field of Search ..... 473/324, 345, 473/346, 409, 449, 342, 350, 349; 29/447

(56) References Cited

U.S. PATENT DOCUMENTS

| | | | |
|---|---|---|---|
| 3,661,388 | * | 5/1972 | Leslie . |
| 5,275,399 | * | 1/1994 | Schmidt . |
| 5,346,216 | * | 9/1994 | Aizawa . |
| 5,417,419 | | 5/1995 | Anderson et al. . |
| 5,509,659 | | 4/1996 | Igarashi . |
| 5,518,240 | | 5/1996 | Igarashi . |
| 5,564,994 | | 10/1996 | Chang . |
| 5,582,553 | * | 12/1996 | Ashcraft . |
| 5,774,970 | * | 7/1998 | Huang . |
| 5,775,736 | * | 7/1998 | Svetlik . |
| 5,807,189 | * | 9/1998 | Martin . |

* cited by examiner

*Primary Examiner*—Sebastiano Passaniti
(74) *Attorney, Agent, or Firm*—Young & Basile, PC

(57) ABSTRACT

A joinder method and article constructed according to the method in which two separate parts are fixedly joined into a unitary one-piece structure by an interference fit between precision mounting surfaces formed on the first and second parts along a mating joint. The dimensions of the first mounting surface are formed oversized with respect to the complementary dimensions of the second mounting surface. The first part is significantly cooled to cause sufficient contraction allowing the first mounting surface to be inserted within the second mounting surface. When warmed, the first part expands to its normal dimensional shape driving the first mounting surface into an interference fit with the second mounting surface. The first and second parts can be formed of dissimilar materials which, in the specific case of a golf club head, uses a heavier and harder material for the second part and a lightweight material for the top part. Optional surface irregularities on the second mounting surface forcibly engage the first mounting surface when the first part expands to its normal dimensional shape. Additional joint strength obtained by preventing oxidation of the mounting surfaces which enables diffusion bonding of the two parts along the mating joint. Temporary mounting tabs are formed about the periphery of each of the first and second parts during formation of the first and second parts for locating the parts in a fixture during formation of the precision mounting surfaces on the parts.

7 Claims, 3 Drawing Sheets

JOINT CONSTRUCTION METHOD AND ARTICLE CONSTRUCTED BY SAID METHOD

CROSS-REFERENCE TO CO-PENDING APPLICATION

This invention describes subject matter which is related to the subject matter disclosed in U.S. patent application Ser. No. 09/316,375, filed May 21, 1999, concurrently herewith for a "Weighted Golf Club Head and Method of Making the Same", by Donald R. Cook.

BACKGROUND OF THE INVENTION

1. Field of the Invention

The present relates, in general, to metal fastening techniques and, more specifically, to methods for joining two metal components into a unitary structure.

2. Description of the Art

Various joining processes are available for unitarily joining two metal components or parts together into a unitary structure. Welding, adhesive bonding, and mechanical fasteners, such as screws, are widely employed to fixedly join two metal components or parts together.

Another metal joining technique utilizes a press fit or interference fit wherein one component or portion of one component has an outer dimension slightly larger or oversized with respect to a mating portion, such as a bore or recess, in another component. The two components are urged together to force the oversized portion of one component into the smaller sized portion of the second component to fixedly join the two components together. While effective in certain applications, a press fit or interference fit requires assembly equipment capable of generating and withstanding the high forces or pressures involved in creating the press fit between two components.

In certain applications, the aesthetic appearance of the assembled part requires that screw heads be covered thereby requiring additional assembly steps to finish the part. Similarly, welding two metal parts together along a joint between the two parts, while forming a secure joint, requires subsequent machining steps, such as grinding, to finish the joint to a smooth surface shape.

One example of a two-part metal component structure is a metal golf club head. Metal drivers have replaced older "wood" club head constructions. While it is possible to cast a hollow, one-piece golf club head, such fabrication techniques have presented difficulties in achieving high quality parts at a reasonable cost. Thus, a hollow metal golf club head is typically formed of two cast parts, such as a main body and a separate face plate or sole plate which are then welded together to form the complete golf club head. This is an expensive, time consuming process and requires additional finishing steps to smooth the weld bead to a smooth exterior surface shape on the golf club head.

Similar joinder techniques are employed in metal golf club irons wherein perimeter weights are mounted in recesses formed generally along the bottom edge of the iron to improve club head balance, to lower the center gravity of the club head and to enlarge the sweet spot on the club face. Such weights are mounted in recesses formed in the iron club body and then welded, brazed or soldered into place. Again, time consuming and the additional finishing steps are required to smooth the weld bead between the weight insert and the club body.

What is needed is a joinder technique or methodology for joining two metal component or parts together into a one-piece unitary structure which minimizes assembly steps of the one-piece structure, provides a secure joint between the two metal parts, and minimizes or preferably eliminates after-assembly finishing steps to lower the manufacturing cost of the one-piece structure or component. It would also be desirable to provide such a joinder methodology to the construction of golf club heads provided with a hollow driver configuration or perimeter weighted iron or putter configurations.

SUMMARY OF THE INVENTION

The present invention is a unique method for joining two metal parts into a unitary one-piece structure or member without welding, brazing, soldering, or the use of mechanical fasteners. The present invention also contemplates an article constructed to the inventive method.

According to one aspect of the present invention, a method of joining first and second parts with mating joint surfaces together into a unitary member comprises the steps of:

- forming first and second parts with complementary mating surfaces;
- forming the dimension of opposed portions of the mating surface of the first part oversized with respect to the corresponding dimension of the second part;
- cooling the first part to sufficiently cause contraction in the dimension of the mating surface of the first part;
- coupling the cooled first part with the second part at the mating surfaces; and
- allowing the cooled first part to warm resulting in expansion of the first part to its original size and forming an interference fit between the complementary mating surfaces of the first and second parts.

The method also includes forming the first and second parts of the same material or dissimilar materials having different thermal expansion characteristics.

In one aspect, the method also forms the cooled first part of a material having a lower hardness than the hardness of the material forming the second part.

In another aspect, the inventive method forms surface irregularities on the mounting surface of the second part which forcibly engage the mating surface of the first part when the cooled first part expands its normal dimensions.

According to another aspect of the present invention, an article, such as a two-part golf club head, by example only, is constructed by the inventive method described herein. The golf club head comprises:

- first and second separate portions having mating first and second mounting surfaces, respectively, to be joined together into a unitary one-piece member;
- opposing portions of the first mounting surface of the first part having a normal dimension larger than the corresponding dimension of the mounting surface of the second part; and
- an interference fit joining the first part to the second part at the mating first and second mounting surfaces by expansion of the first part to its normal dimensional shape after contraction caused by cooling.

In one aspect, the first and second parts are formed of dissimilar materials.

In another aspect, the material forming the second part is heavier and/or denser than the material forming the first part.

In another aspect, the second part is harder than the first part.

In yet another aspect, the second mounting surface of the second part has surface irregularities projecting outward therefrom which embed in the mounting surface of the first part as the first part expands.

The unique method and article formed by said method of the present invention provides joinder of two metal components into a unitary one-piece structure without the need for welding, brazing, or soldering operations which typically require subsequent surface finishing steps and a resultant increase in the manufacturing cost of the part as well as eliminating the need for mechanical fasteners to join the two parts together. By eliminating welding, brazing or soldering joinder operations, any possibility of heat tempering of either part is eliminated thereby minimizing any potential distortion in the shape or mating mounting surfaces of the two parts which could decrease the mechanical strength of the joint between the two joined parts. Thus, the method and article constructed according to the method of the present invention minimizes joinder failures due to inadequate joints.

When the article is a two-part golf club head constructed according to the inventive method, further advantages are obtained. When the bottom portion of the golf club head is formed of a heavier and harder material than a lighter weight top portion, the resulting golf club head, besides having a reduced manufacturing cost due to the elimination of surface finishing steps required by the prior art use of welding, etc., to join a two-part golf club head together, also has better weight distribution due to a low center of gravity since the bottom portion of the club is heavier than the top portion. This results in a better balance and higher performance of an inventive golf club head according to the present invention.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
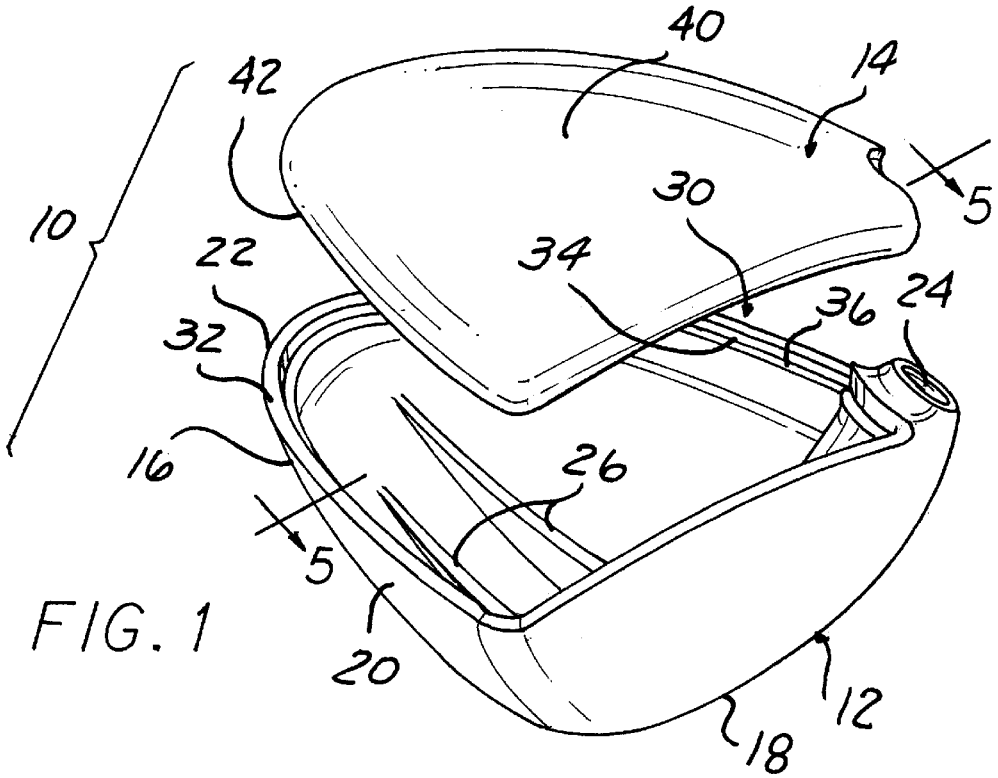
FIG. 1 is an exploded, perspective view of a golf club head constructed to the method of the present invention.
Figure 2:
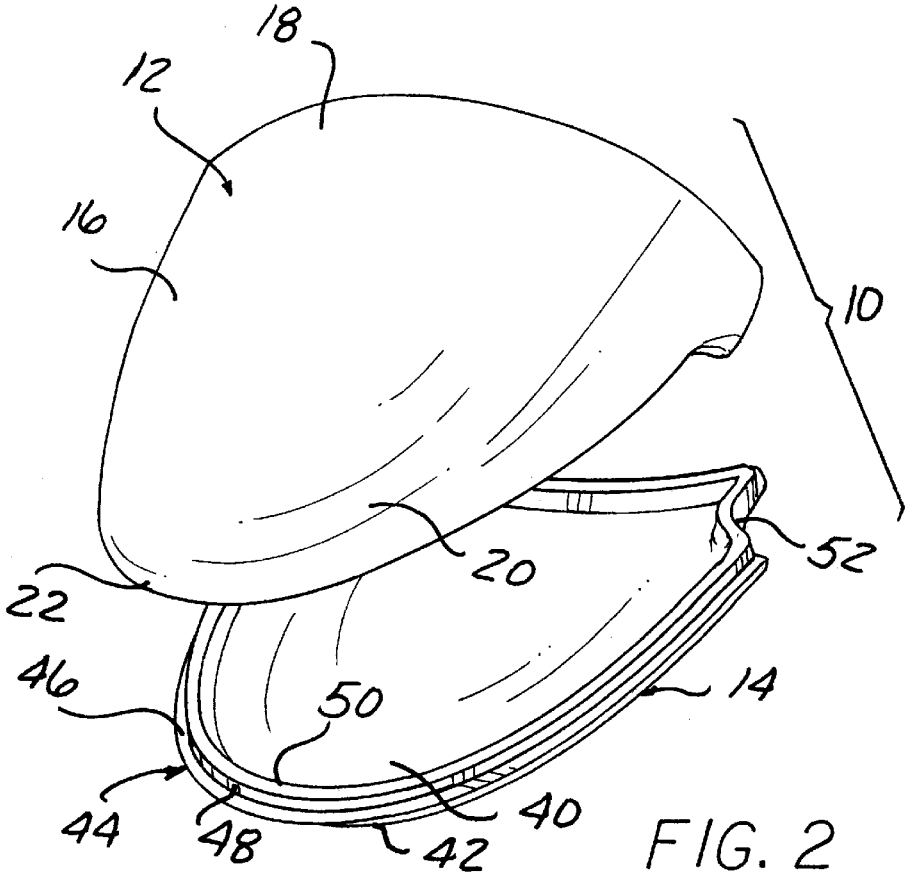
FIG. 2 is an inverted, exploded, perspective view of the golf club head shown in FIG. 1.

The present invention is a unique method of fixedly joining two metal components or parts together into a unitary one-piece structure as well as articles made by said method. It will be understood that the present method is adaptable to many different articles.

It will also be understood that the following description of the present inventive method and an article constructed using said method in which the article comprising a two-part golf club head, is by way of example only and not intended to limit the particular joint configuration or article made by the present method.

Referring to FIGS. 1–5, there is depicted an article which, by way of example only, is a two-part golf club head 10 formed of a bottom portion or part 12 and a top portion or part 14. The bottom portion 12 and the top portion 14 of the golf club head 10 are joined together by the present method, described hereafter, into a unitary one-piece structure without the need for mechanical fasteners, welding, adhesives, etc., typically employed in joining two metal components together, particularly when forming a golf club head of two parts.

Again, by way of example only, the bottom portion 12 of the golf club head 10 has a generally concave shape formed of a bottom wall or sole 16, a face or striking surface 18 and an upturned sidewall 20 terminating in a peripheral edge 22. A hostel receiver 24 is formed at one corner of the bottom portion 12 for receiving a hostel to interconnect the club head 10 to a shaft. In addition, a pair of strengthening ribs 26, by example only, are integrally formed on the sole 16 and project upwardly therefrom.

According to one aspect of the present invention, a mounting surface denoted by reference number 30 is formed about the peripheral edge of at least a portion and, preferably, substantially all of the peripheral edge 22 of the bottom portion 12. By example only, the mounting surface 30 extends across the face surface 18 and the entire sidewall 20 of the bottom portion 12 except for a short distance around the hostel receiver 24.

Figure 5:
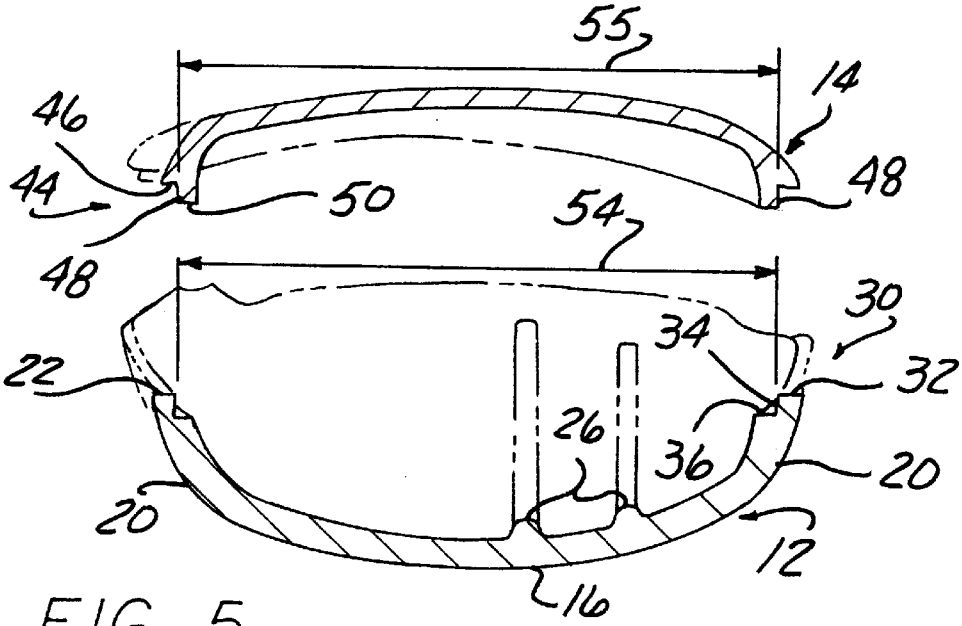
FIG. 5 is an exploded, cross-sectional view, generally taken along line 5—5 in FIG. 1 of the assembled top and bottom portions of the golf club head.

As shown more clearly in FIG. 5, the mounting surface 30, according to one aspect of the present invention, has a step configuration formed of a top wall 32 extending radially inward from the peripheral edge 22, an intermediate wall 34 depending from an inner edge of the top wall, and an inner wall 36, generally parallel to the top wall 32 which extends from one end of the intermediate wall 34 to an edge of an inner surface of the sidewall 20 of the bottom portion 12.

The intermediate wall 34 depends substantially perpendicularly from the top wall 32 and is also substantially perpendicular to the inner wall 36. It will be understood that other joint configurations may also be possible as long as the intermediate wall 34 which forms the main resistive surface to expansion of the corresponding mating mounting surface of the top portion 14, as described hereafter, is at an angle of no more than 90° with respect to the mating mounting surface of the top portion 14. Thus, it is possible with the present invention to form the mounting surface 30 of the bottom portion 12 in which the intermediate wall 34 depends at an acute angle with respect to the lower inner wall 36 to form a dovetail configuration. The bottom edge of the mating mounting surface on the top portion 12 must contract sufficiently to clear the edge between the top wall 32 and the intermediate wall 34.

As with the bottom portion 12, the intermediate wall 48 of the top portion 14 is depicted as extending substantially perpendicularly from the inward extending wall 46 and the outer end wall 50. It will be understood that the intermediate wall 48 may also project at an acute angle with respect the inner wall 50 for mating engagement with a similarly formed mounting surface on the bottom portion 12.

The top portion 14 of the golf club head 10, as shown in FIGS. 1, 2, 4 and 5, has a top surface 40 having a slightly contoured shape and an outer peripheral wall 42 depending from the top surface 40. A mounting surface 44 is formed inboard of the outer peripheral wall 42 and, as shown in greater detail in FIG. 5, is in the form of a depending leg having a radially inward extending wall 46, an intermediate wall 48 depending from the inner wall 46 and an outer end wall 50 generally parallel to the inner wall 46 and projecting radially inward from the intermediate wall 48.

The mounting surface 44 on the top portion 14 has a step configuration identical to the step configuration of the mounting surface 30 on the bottom portion 12 of the golf club head 10 for secure mating engagement therebetween.

Figure 4:
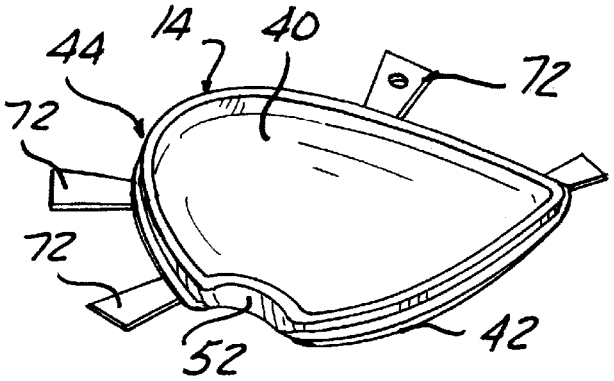
FIG. 4 is a bottom, perspective view of the top portion of the golf club head shown in FIGS. 1 and 2.

As shown in FIG. 4, the mounting surface 44 on the top portion 14 extends about the entire outer peripheral edge 42 of the top portion 14 except for a small recess 52 which is disposed adjacent to the hostel receiver 24 in the bottom portion 12 when the bottom portion 12 and top portion 14 are joined together.

The mounting surfaces 30 and 44 are separately precision cut to an identical, complementary shape. This assures that when the top and bottom portions 14 and 12 are joined together, the mounting surfaces 44 and 30, respectively, securely engage each other about their entire peripheral length.

As shown in FIG. 5, dimension 54 depicts the spacing or distance between the opposed points on the intermediate walls of the mounting surface 30 in the bottom portion 12. Dimension 55 depicts the spacing or distance between two opposed points on the exterior surfaces of the opposing intermediate walls 48 of the top portion 14. The dimension 54 will be understood to define a dimension between two diametrically opposed points or portions on the mounting surface 30 of the bottom portion 12. Similarly, the dimension 55 represents the dimension between any two diametrically opposed points on the mounting surface 44 of the upper portion 14, which points on the upper mounting surface 44 will be disposed in registry with the corresponding points on the mounting surface 30 depicted by the dimension 54 in FIG. 5. Similar dimensions 54 and 55 will be established for each pair of diametrically opposed points on the bottom and top portions 12 and 14 between the sidewalls 20 or between the front and rear walls 16 and 18 of the bottom portion 12 and the corresponding portions on the top portion 14.

Before describing the interaction of the mounting surfaces 30 and 44 according to the present inventive method, a brief discussion of the materials used to form the bottom portion 12 and the top portion 14 of the golf club head will be provided. Generally, any suitable material may be employed for the bottom portion 12 and the top portion 14. Such materials include steel, stainless steel, aluminum, titanium and various alloys thereof.

Further, it is possible to form the bottom portion 12 and the top portion 14 of the golf club head 10 of the same material, such as aluminum, titanium, stainless steel, etc. However, further advantages may be obtained if a heavier weight or density material, such as titanium, is employed for the bottom portion 12 and a lighter weight material, such as aluminum, is used to form the top portion 14. Such a construction provides better weight balance in a golf club by lowering the center of gravity of the golf club head due to the heavier bottom portion 12. Thus, by example only, the bottom portion 12 is formed of titanium; while the top portion 14 of the golf club head 10 is formed of a lighter weight aluminum.

Thus, the dimension 55 defines an outer peripheral edge on the mounting surface 44 of the top portion 14 and dimension 54 defines an inner peripheral edge on the mounting surface 30 of the bottom portion 14 which are to be brought into engagement to prevent separation or disengagement of the top portion 14 from the bottom portion 12. Even though the outer peripheral edge of the intermediate wall 48 on the top portion 14 is to be brought into secure engagement with the inner surface of the intermediate wall 34 of the bottom portion 12, according to the present method, the dimension 55 representing the distance or spacing between two points or opposing portions of the intermediate wall 48 on the top portion 14 is intentionally made slightly oversize with respect to the dimension or spacing between the two corresponding points on the inner peripheral surfaces of opposing portions of the intermediate wall 34 of the bottom portion 12. By way of example only, the dimension 55 on the top portion 14 is formed oversize by about 0.005 inches to about 0.010 inches with respect to the similar dimension 54 between spaced portions of the intermediate wall 34 of the bottom portion 12, with an oversize amount of about 0.007 to about 0.008 inches being preferred.

The formation of this oversize dimension is the first step in the present inventive method. Next, the top portion 14 is subjected to substantially below 0° F., such as to about −280° F., cooling, by placing the top portion 14 in a liquid nitrogen tank or bath, or by spraying liquid nitrogen over the upper portion 14 to cause significant shrinkage or contraction of the top portion 14 in all directions or axes, particularly a reduction in the dimension 54 between two opposing outer surfaces of the intermediate wall 48 on the top portion 14.

This shrinkage enables the mounting surface 44 on the top portion 14 to be inserted within the mating mounting surface 30 of the bottom portion 12 while the top portion 14 is still substantially cooled significantly below 0° C. Different cooling temperatures may be employed with different oversize dimensions 54 on the top portion 14 or different materials to achieve the same end result.

Next, when the top portion 14 has been sufficiently cooled to impart the desired amount of contraction or reduction in overall size, the top portion 14 is mated to the bottom portion 12 by insertion of the mounting surfaces 44 into the mounting surface 30 on the bottom portion 12, respectively. The top portion 14 then immediately warms to ambient temperature or to the temperature of the bottom portion 12 causing an expansion of the top portion 14, particularly between the depending portions of the mounting surface 44 of the top portion 14. This forces the opposing portions of the depending leg or intermediate wall 48 of the mounting surface 44 of the top portion 14 into tight engagement with the corresponding portion on the intermediate wall 34 of the mounting surface 30 of the bottom portion 12.

When the top portion 14 reaches ambient temperature, it will have expanded back to its original oversize dimension wherein the dimension 55 between two opposing portions of the outer surfaces of the intermediate wall 48 of the top portion 14 is larger than the mating portions of the bottom mounting surface 30. This oversize dimension forces the depending leg of the mounting surface 44 of the top portion 14 into an interference fit with the mating portions of the mounting surface 30 of the bottom portion 12 thereby securely mounting the top portion 14 to the bottom portion 12 without the need for mechanical fasteners, welding or the significant forces and equipment for generating forces used to press fit or interference fit two parts together.

Figure 6:
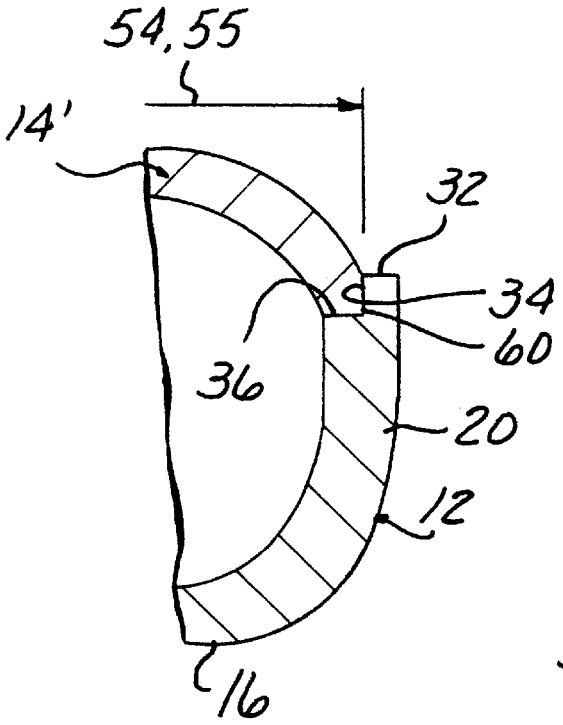
FIGS. 6 and 7 are partial cross-sectional views, similar to FIG. 5, but showing alternate joint constructions according to the present invention.

An alternate joint is shown in FIG. 6 in which the top portion 14' has a mounting surface formed simply by forming the outer peripheral edge 42 as a flat wall 60 which seats against the inner surface of the intermediate wall 34 of the bottom portion 12. An outer bottom edge of the top portion 14' seats on the inner wall 36 of the mounting surface 30 of the bottom portion 12. The critical dimensions 54 and 55 defining the mating joint between the top portion 14' and bottom portion 12, is between the opposing portions of the flat wall 60. Otherwise, the two component construction shown in FIG. 6 is identical to that described above and shown in FIG. 5.

Figure 7:
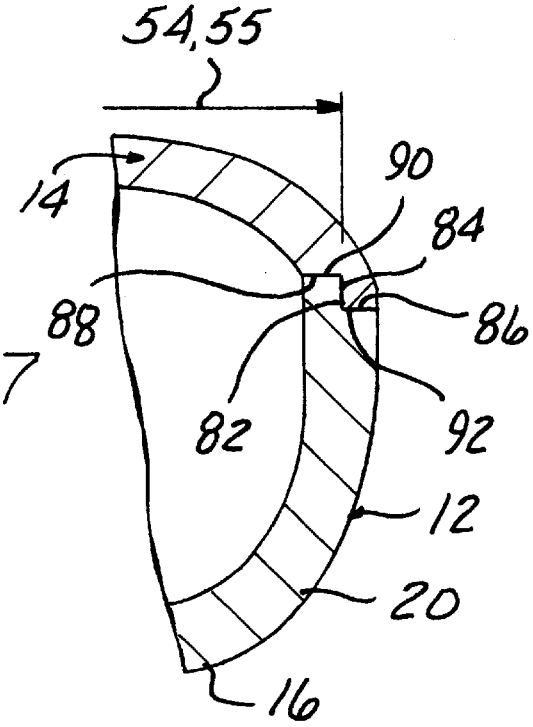

Another alternate joint configuration according to the present invention is shown in FIG. 7. In this joint configuration, the mounting surface 80 on the bottom portion 12 has a top wall 82 extending radially outward from an inner edge of the inner surface of the sidewall 20 of the bottom portion 12. An intermediate wall 84 depends from the outer edge of the top wall 82 and terminates in a further radially outward extending outer wall 86.

The top portion 14, in this embodiment, has a mounting surface formed of an inner wall 88 extending radially outward from an edge of the inner surface of the top portion 14. The inner wall 88 terminates in a depending intermediate wall 90 which extends substantially perpendicularly from the inner wall 88. An outer wall 92 projects from the opposite end of the intermediate wall 90.

In this aspect of the present invention, the bottom portion 12 is formed oversize, at least with respect to the dimension between diametrically opposing portions of the intermediate wall 84 by the above described amount between about 0.005 inches to about 0.010 inches. The bottom portion 12 is then cooled to approximately −280° F. to cause contraction of the entire bottom portion 12 in all directions. The mounting surfaces between the bottom and top portions 12 and 14 are then mated and the bottom portion 12 allowed to warm to ambient temperature. This causes an expansion of the bottom portion 12 to its normal dimensions thereby driving the intermediate walls 84 of the bottom portion 12 into secure, fixed engagement with the corresponding intermediate wall 90 of the top portion 14.

Although the joint shown in FIG. 7 may not be as strong as the joint shown in FIG. 6 since the top portion would typically be formed of a lighter weight material in a golf club head which is a potentially weaker material then that used to form the bottom portion 7, in certain applications, including golf clubs, as well as non-golf club articles, such a joint configuration may have certain advantages.

Figure 8:
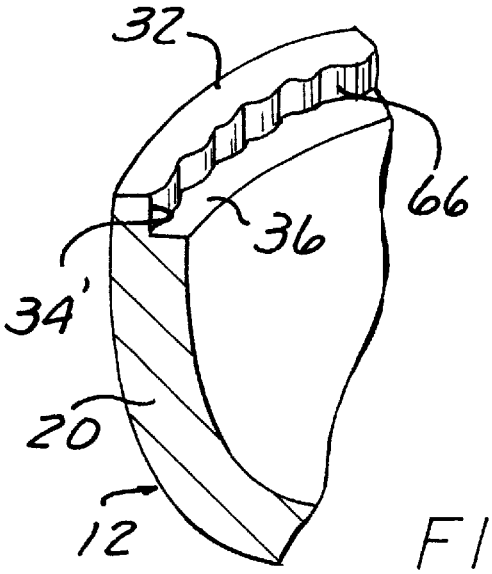
FIG. 8 is a partial cross-sectional view of an another aspect of the present invention.

FIG. 8 depicts an alternate aspect of the present invention in which the mounting surface 30 is formed of a harder material, such as titanium, has an intermediate wall 34' formed with surface irregularities 66 to enhance the mechanical connection between the top portion 14 and the bottom portion 12. The surface irregularities 66 can take any one of a number of different forms, such as score lines similar to that used in rifle bores, serrated edges, radially inward facing projections, etc. In operation, during expansion of the cooled top portion 14, the surface irregularities 66 embed themselves into the intermediate wall 48 of the top portion 14 for a more secure mechanical fit between the top portion and the bottom portion 12.

Although the interference fit joint between two mating parts according to the present invention can take a variety of configurations, what is crucial is that the mating mounting surfaces of the two parts be formed such that the mounting surface of one part is disposed outermost of a corresponding mating mounting surface of the opposite part and has a wall portion, defined herein as the intermediate wall 34 of the embodiment shown in FIG. 5 or the intermediate wall 82 shown in the embodiment depicted in FIG. 7, which lies in the plane of expansion of the mating portion of the opposite part so as to engage and resist complete expansion of the opposite part and to thereby create the strong, interference fit joint between the two parts.

In a preferred configuration, the mounting surfaces of one of the parts defines a peripheral edge surrounding an opening into which the mounting portion of the opposite part is inserted. The interfering wall or surface of the one part which receives and resists expansion of the other part lies in a plane which is perpendicular to the insertion axis of one part into the other.

According to another aspect of the present invention, the strength of the mechanical joint between the top portion 14 and the bottom portion 12, according to the method described above, may be further enhanced by providing diffusion bonding of the metals forming the top portion 14 and the bottom portion 12 at the mating joint. Typically, metal mating surfaces, such as aluminum or titanium, by example, oxidize to form a coating that prevents further surface reaction. By casting the bottom portion 12 and the top portion 14 and then joining the bottom portion 12 and the top portion 14 together, according to the method described above, immediately after casting and without allowing the mounting surfaces 30 and 44 of the bottom portion 12 and the top portion 14 to oxidize, the metals at the joint mounting surfaces 30 and 44 will diffuse bond together during expansion of the cooled top portion 14 into engagement with the bottom portion 12 to further increase the strength of the joint between the bottom portion 12 and the top portion 14.

Figure 3:
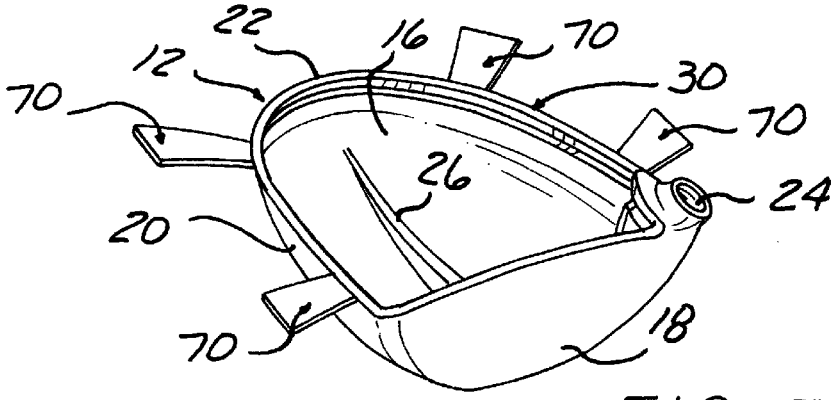
FIG. 3 is a top perspective view of the bottom portion of the golf club head shown in FIGS. 1 and 2.

Referring to FIGS. 3 and 4, there is depicted another aspect of the present invention in which at least one and preferably a plurality of spaced mounting tabs, each denoted by reference number 70 for the bottom portion 12 and by reference number 72 for the top portion 14, are integrally cast during the initial formation or casting of the bottom portion 12 and the top portion 14. The tabs 70 and 72 can take any of a number of different shapes, but generally comprise a planar member projecting radially outward from the sidewall 20 or outer peripheral edge 22 of the bottom portion 12 as shown in FIG. 3 or from the outer peripheral edge 42 of the top portion 14 as shown in FIG. 4.

The tabs 70 and 72 act as locators to accurately position the bottom portion 12 and the top portion 14 in a holding fixture during precision machining of the mounting surfaces or edges 30 and 44. The tabs 70 and 72 fit into mating recesses or cavities in a fixture having a complementary shape to the shape of the tabs 70 and 72. In one aspect, each tab 70 and 72 has a through bore drilled or otherwise formed therein which seats over a locating pin in the holding fixture to locate the bottom portion 12 or the top portion 14 in the proper position relative to a zero reference location on a machining table or machine.

The tabs 72 can also be used to support the top portion 14 in the liquid nitrogen tank or bath during cooling of the top portion 14.

Otherwise, after the individual bottom portion 12 or top portion 14 is formed and the mounting surfaces 30 and 44, respectively, precision formed thereon, the tabs 70 and 72 are cut off and the surface of the bottom and top portions 12 and 14 from which the tabs 70 and 72 projected ground or otherwise finished to a smooth exterior finish.

In summary, there has been disclosed a unique method of joining two metal parts together into a one-piece unitary structure as well as inventive articles constructed in accordance with said method. By substantially cooling one part, which is initially formed dimensionally oversize at the joint surface, to a sufficiently low temperature to cause a predetermined amount of contraction of the one part, the cooled part may be inserted into the mating part along adjoining mounting surfaces such that expansion of the cooled part back to its normal, oversize dimensional shape will cause an interference fit between the mounting surfaces of the two parts without the need for mechanical fasteners, welding, solder, brazing, adhesive, etc., which typically require additional machining or surface finishing steps to create a smooth joint between the two parts. The inventive method also eliminates heating of one or both of the parts, such as required by welding, brazing or soldering, which could affect the hardness of the materials forming the parts as well as potentially distorting their shape, particularly at the mating mounting surfaces. The interference fit mounting surfaces of the present method expands the possibilities for new appearances and designs of a large number of articles since the specific design requirements for forming a joint by welds, mechanical fasteners, etc., are eliminated.

What is claimed is:

1. A golf club head comprising:

first and second separate parts having mating first and second mounting surfaces, respectively, to be joined together into a unitary one-piece golf club head;

the first and second mounting surfaces of the first and second parts, respectively, having opposing surface portions, respectively, which lie in a plane of expansion of the first part with respect to the second part;

opposing surface portions of the first mounting surface of the first part having a normal dimension larger than the corresponding dimension of opposing surface portions of the mounting surface of the second part;

the opposing surface portions of one of the first and second parts defining an outward protecting step, and the opposing surface portions of the other of the first and second parts defining a recessed step complementary to the outward projecting step, the outward projecting step and the recessed step spaced inward of a periphery of the first and second parts; and an interference fit joining the first part to the second part by mating of the first and second mounting surfaces by expansion of the first part to the normal dimensional shape after contraction of the first part during cooling.

2. The golf club head of claim 1 wherein the first and second portions comprise a top portion and a bottom portion of a hollow golf club head having an interior cavity formed therebetween.

3. The golf club head of claim 1 wherein the second mounting surface of the second part has surface irregularities projecting outward therefrom.

4. The golf club head of claim 1 wherein the first and second parts are formed of dissimilar materials.

5. The golf club head of claim 1 wherein the material forming the second part has a higher weight than the weight of the material forming the first part.

6. The golf club head of claim 1 wherein the material forming the second part is harder than the material forming the first part.

7. The golf club head of claim 6 wherein the second mounting surface of the second part has surface irregularities projecting outward therefrom embedable in the first mounting surface of the first part as the first part expands.

* * * * *